US005944435A

United States Patent [19]

Chai

[11] Patent Number: 5,944,435

[45] Date of Patent: Aug. 31, 1999

[54] MECHANICAL PENCIL STRUCTURE

[76] Inventor: David Ching-Her Chai, No. 3, Alley 58, Lane 111, Chung Ching Rd., Pei Tun Dist., Taichung, Taiwan

[21] Appl. No.: 08/963,044

[22] Filed: Nov. 3, 1997

[51] Int. Cl.[6] ..... B43K 21/06; B43K 21/18

[52] U.S. Cl. ..... 401/82; 401/31; 401/52; 401/84

[58] Field of Search ..... 401/82, 83, 84, 401/52, 87, 31

[56] References Cited

U.S. PATENT DOCUMENTS

| | | | |
|---|---|---|---|
| 561,734 | 6/1896 | Steele | 401/84 |
| 1,223,579 | 4/1917 | Grynik | 401/52 X |
| 1,567,738 | 12/1925 | Knight | 401/82 X |
| 1,606,909 | 11/1926 | Wahl | 401/87 |
| 2,459,701 | 1/1949 | Harper | 401/84 |
| 3,756,727 | 9/1973 | Gallagher | 401/84 |
| 3,923,405 | 12/1975 | Kao | 401/82 |

FOREIGN PATENT DOCUMENTS

| | | | |
|---|---|---|---|
| 326012 | 9/1920 | Germany | 401/84 |

*Primary Examiner*—Steven A. Bratlie
*Attorney, Agent, or Firm*—Heller Ehrman White & McAuliffe

[57] ABSTRACT

A mechanical pencil structure includes an elongate housing defining a receiving passage therethrough. A substantially U-shaped guiding recess is defined in the elongate housing by two side walls and a bottom wall and is located above the receiving passage. An opening is defined in the bottom wall defining the guiding recess and communicates with the receiving passage. A pencil is slidably received in the receiving passage and a control member is slidably mounted in the guiding recess and is securely engaged with one end portion of the pencil for moving the pencil.

9 Claims, 8 Drawing Sheets

MECHANICAL PENCIL STRUCTURE

FIELD OF THE INVENTION

The present invention relates to a pencil structure.

BACKGROUND OF THE INVENTION

A conventional mechanical pencil structure is shown in FIG. 10, and a complete illustration will follow in the detailed description of the preferred embodiments.

The present invention has arisen to mitigate and/or obviate disadvantages of the conventional pencil structure.

SUMMARY OF THE INVENTION

In accordance with one aspect of the present invention, there is provided a mechanical pencil structure comprising an elongate housing including a first end portion and a second end portion. A receiving passage is longitudinally defined through the elongate housing. A substantially U-shaped guiding recess is longitudinally defined in the elongate housing by two side walls and a bottom wall and is located above the receiving passage. An opening is defined in the bottom wall defining the guiding recess and communicates with the receiving passage.

A pencil is slidably received in the receiving passage and includes a first end portion and a second end portion located adjacent to the first and the second end portion of the elongate housing respectively.

A control member is slidably mounted in the guiding recess and is securely engaged with the second end portion of the pencil for moving the pencil.

Further features of the present invention will become apparent after a careful reading of the detailed description with appropriate reference to the accompanying drawings.

DETAILED DESCRIPTION OF THE PREFERRED EMBODIMENTS

Figure 10:
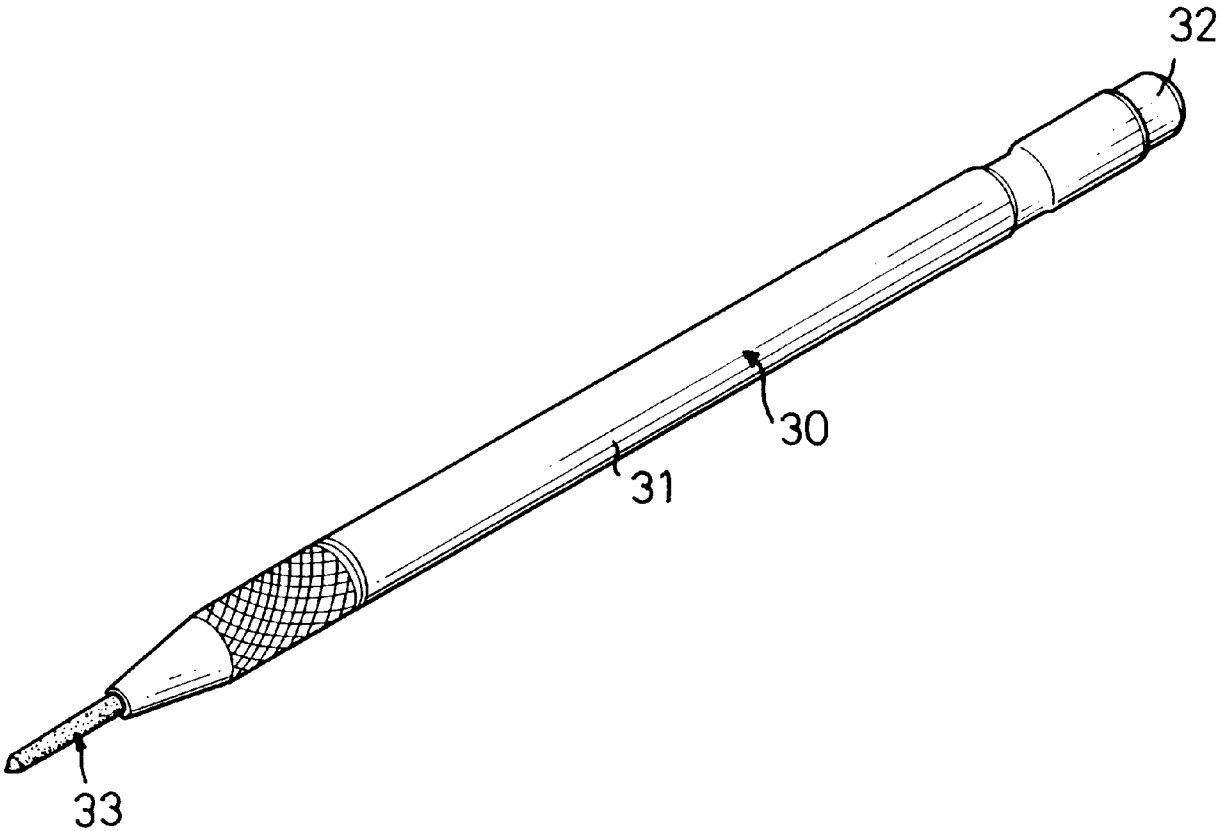
FIG. 10 PRIOR ART
FIG. 10 is a perspective view of a conventional mechanical pencil structure according to the prior art.

For a better understanding of features and benefits of the present invention, reference is now made to FIG. 10, illustrating a conventional mechanical pencil structure 30 according to the prior art.

The conventional mechanical pencil structure 30 comprises an elongate housing 31, a graphite rod 33 slidably received in the elongate housing 31, and a press button 32 mounted on one end portion of the elongate housing 31 for pressing the graphite rod 33 outwardly.

However, in such a pencil, the user has to press the free end of the graphite rod 33 inwardly to retract it when not in use, and this may be inconvenient.

Referring now to FIGS. 1–6, a mechanical pencil structure in accordance with a first embodiment of the present invention comprises an elongate housing 10 including a first end portion and a second end portion. A receiving passage 11 is longitudinally defined through the elongate housing 10.

Figure 3:
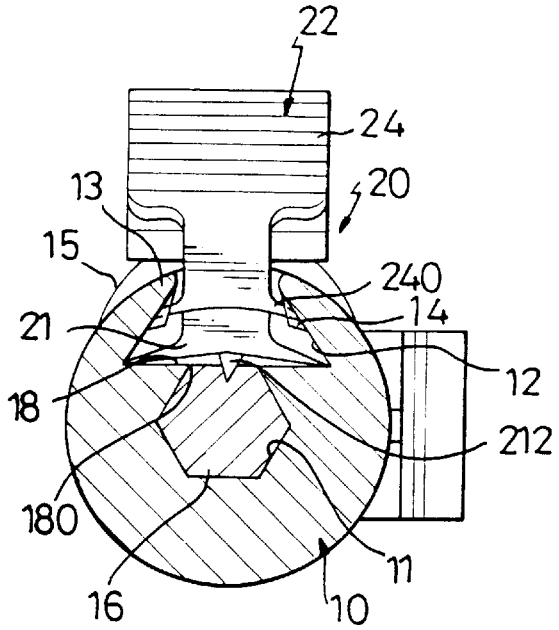
FIG. 3 is a side cross-sectional view of FIG. 1.

A substantially U-shaped guiding recess 12 is longitudinally defined in the elongate housing 10 by two side walls 13 and a bottom wall 18 and is located above the receiving passage 11 as shown in FIG. 3. An opening 180 is defined in the bottom wall 18 defining the guiding recess 12 and communicates with the receiving passage 11.

Each of the two side walls 13 defining the guiding recess 12 includes a bump 15 located adjacent to the second end portion of the elongate housing 10.

A graphite rod 16 is slidably received in the receiving passage 11 and includes a first end portion 162 and a second end portion 164 located adjacent to the first end portion and the second end portion of the elongate housing 10 respectively.

The graphite rod 16 has a hexagonal cross-section, and the receiving passage 11 has a mating hexagonal cross-section.

A control member 20 is slidably mounted in the guiding recess 12 and is securely engaged with the second end portion 164 of the graphite rod 16 for moving the graphite rod 16.

Each of the two side walls 13 defining the guiding recess 12 has an upper portion formed with a plurality of ratchet teeth 14.

Figure 5:
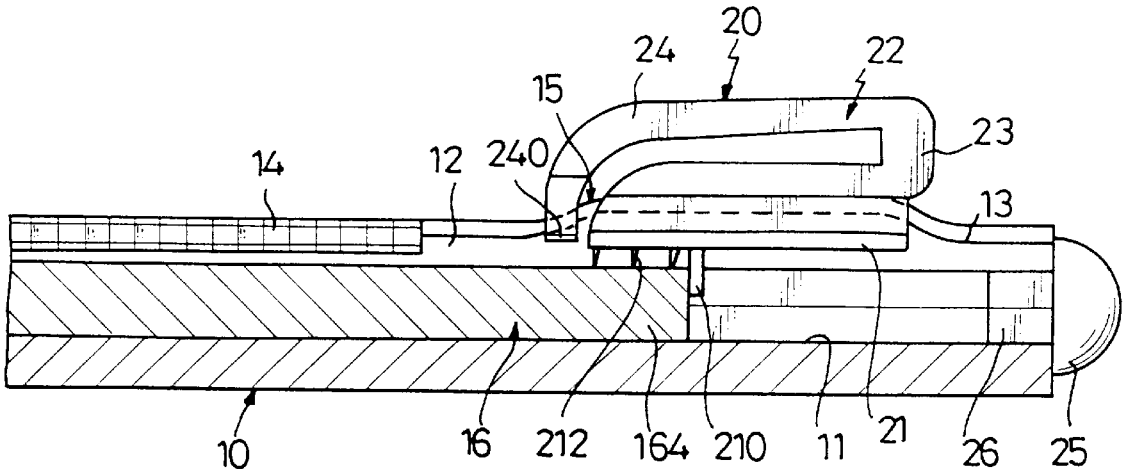
FIG. 5 is a front plan cross-sectional view of FIG. 1.
Figure 6:
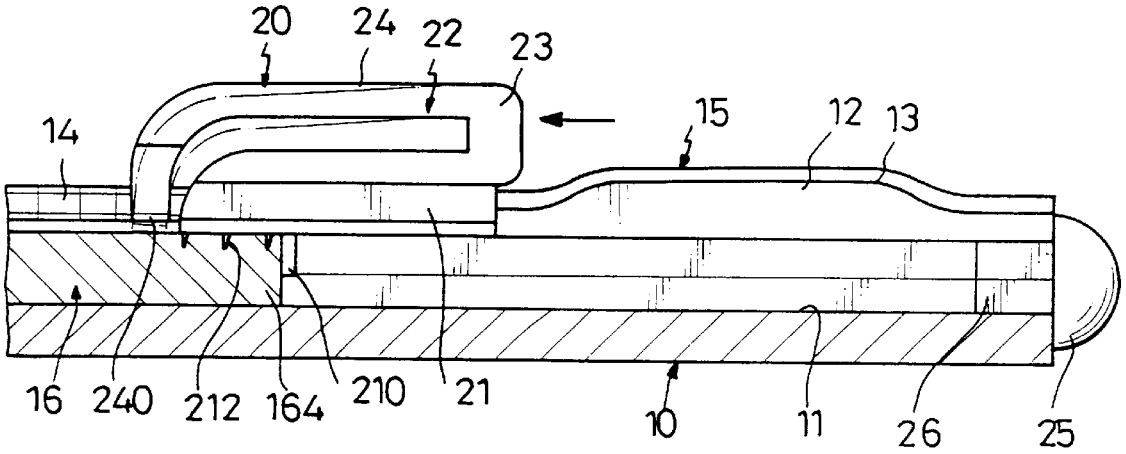
FIG. 6 is an operational view of FIG. 5.

The control member 20 includes a sliding base 21 slidably received in the guiding recess 12, a plurality of engaging teeth 212 fixedly mounted on an underside of the sliding base 21 and detachably engaged in the second end portion 164 of the pencil 16, and an abutting stub 210 extending from the underside of the sliding base 21 and abutting on the second end portion 164 of the graphite rod 16 as shown in FIGS. 5 and 6.

Figure 4:
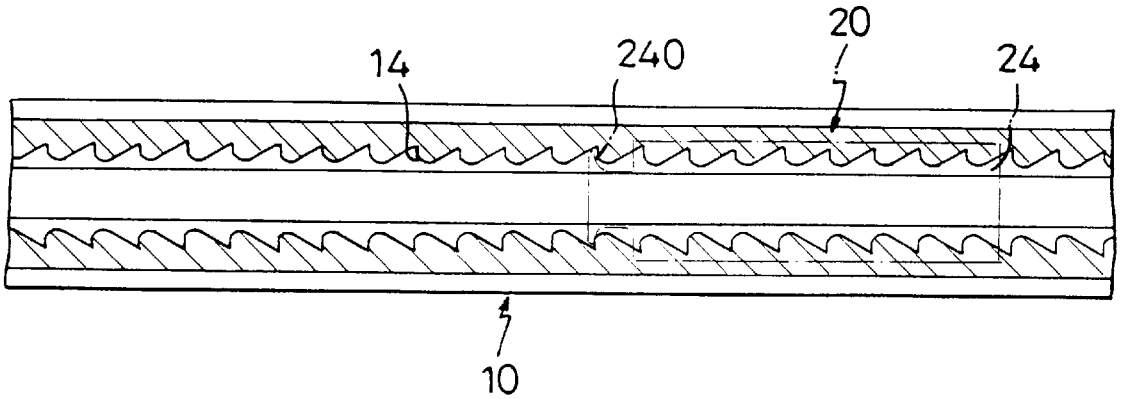
FIG. 4 is a partial top plan cross-sectional view of FIG. 1.

An inverted L-shaped resilient plate 22 includes a vertical section 23 extending upwardly from the sliding base 21 and a horizontal section 24 formed with a pawl 240 detachably meshing with the ratchet teeth 14 of each of the two side walls 13 defining the guiding recess 12 as shown in FIG. 4.

An end cap 25 encloses the second end portion of the elongate housing 10 and includes a plug 26 detachably received in the receiving passage 11.

A pencil sharpener 27 is detachably mounted on the second end portion of the elongate housing 10 and defines a socket 29 for receiving the second end portion of the elongate housing 10.

In operation, referring to FIGS. 5 and 6 with reference to FIGS. 1–4, the sliding base 21 of the control member 20 can be guided in the guiding recess 12 to move leftward from a first position as shown in FIG. 5 to a second position as shown in FIG. 6, thereby moving the graphite rod 16 leftward by means of the abutting stub 210 urged on the second end portion 164 of the graphite rod 16 and by means of the plurality engaging teeth 212 snapped into the second end portion 164 of the pencil 16.

In such a situation, the sliding base 21 can be moved leftward only and cannot be moved back rightward due to the pawl 240 of the resilient plate 22 meshing with the ratchet teeth 14 of the elongate housing 10.

Especially referring to FIGS. 3 and 6, the horizontal section 24 of the resilient plate 22 can be pressed downwardly to a position as shown in phantom lines, thereby detaching the pawl 240 from the ratchet teeth 14 such that the sliding base 21 together with the graphite rod 16 can be moved backward to its original position.

Figure 7:
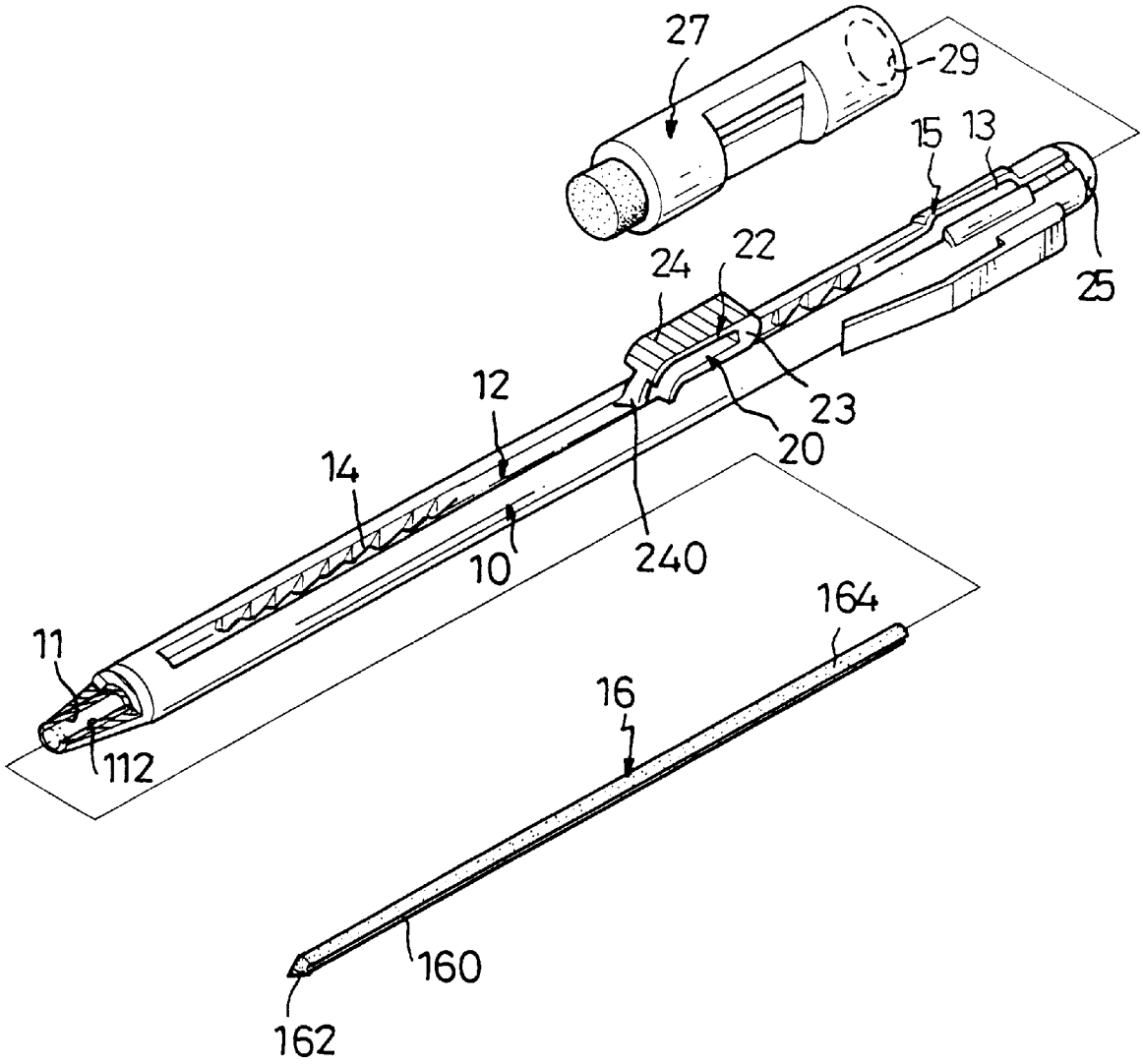
FIG. 7 is a perspective view of a mechanical pencil structure according to a second embodiment of the present invention.
Figure 8:
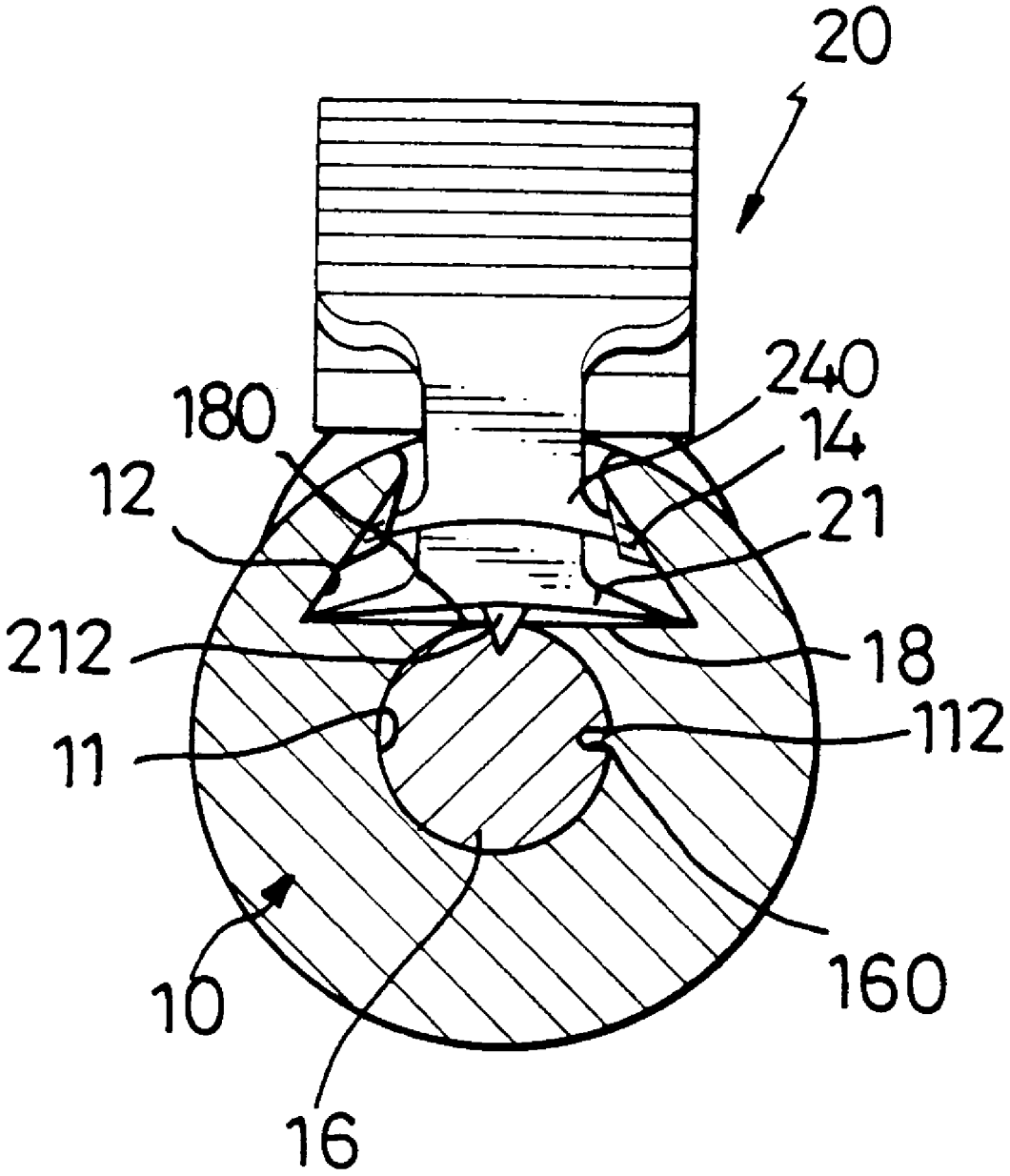
FIG. 8 is a side cross-sectional view of FIG. 7.

Referring to FIGS. 7 and 8, in accordance with a second embodiment of the present invention, the graphite rod 16 has a cylindrical cross-section, and the receiving passage 11 has a mating cylindrical cross-section.

The graphite rod 16 longitudinally defines a groove 160, and an elongate rib 112 is formed on a wall defining the receiving passage 11 and is received in the groove 160 such that the graphite rod 16 cannot be arbitrarily rotated relative to the elongate housing 10, thereby efficiently positioning the graphite rod 16 in the receiving passage 11.

Figure 1:
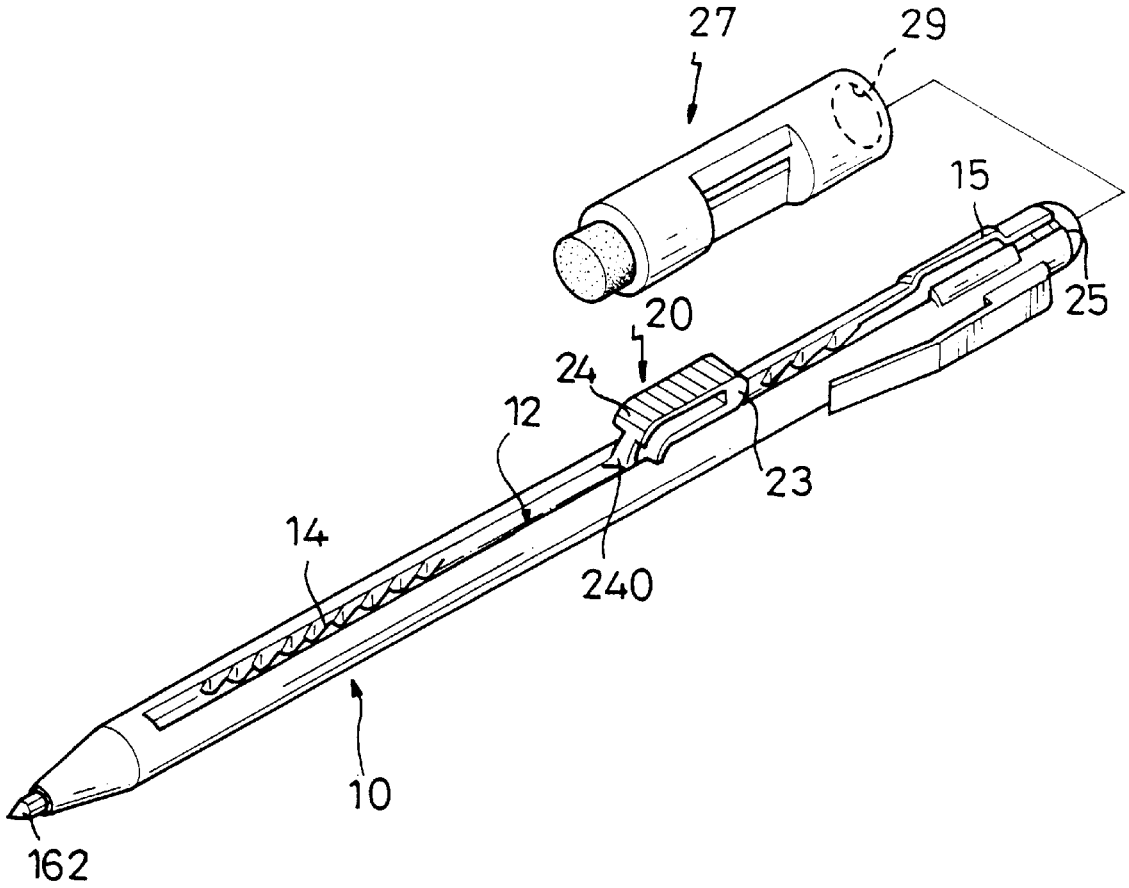
FIG. 1 is a perspective view of a mechanical pencil structure in accordance with a first embodiment of the present invention.
Figure 2:
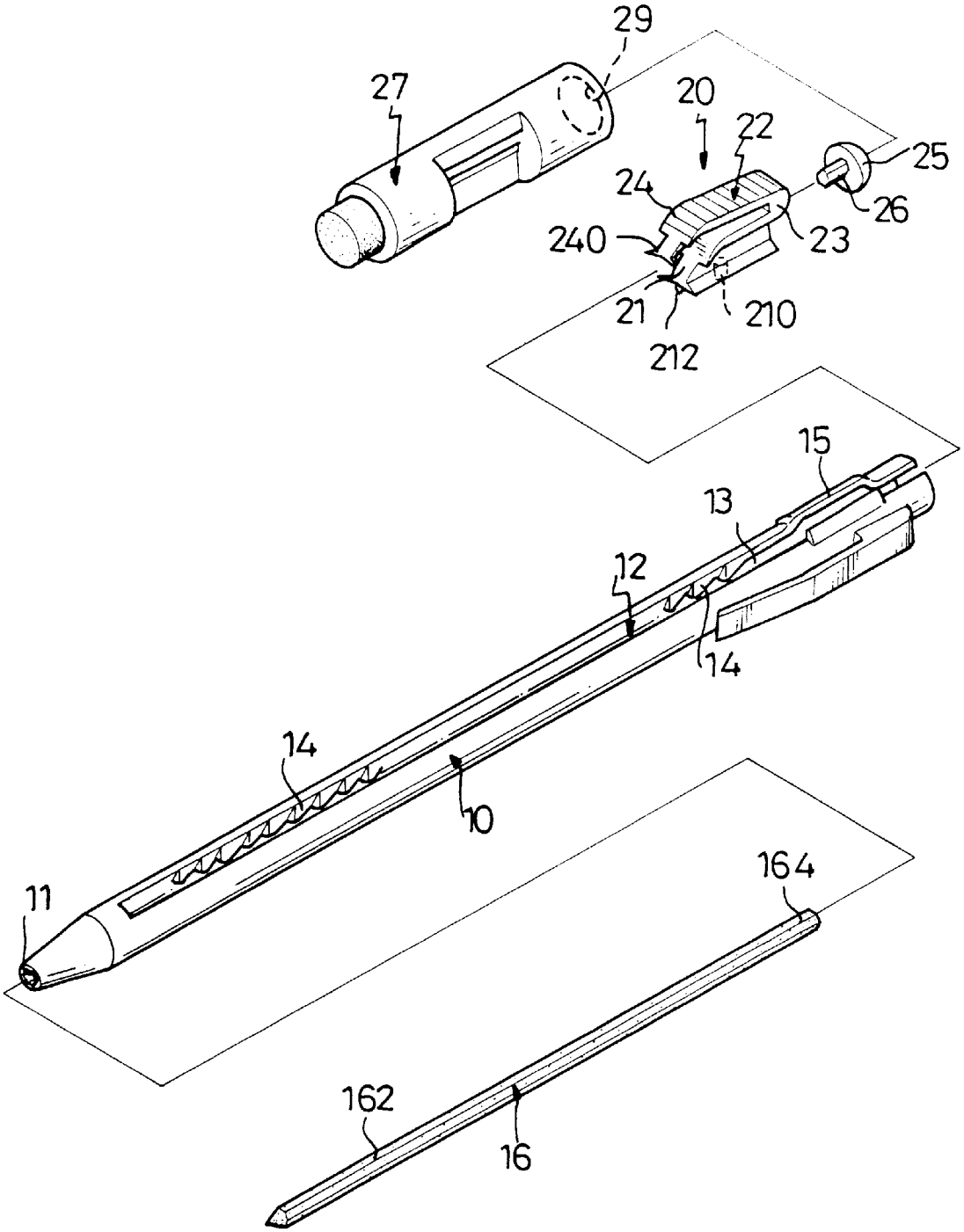
FIG. 2 is an exploded view of the mechanical pencil structure as shown in FIG. 1.
Figure 9:
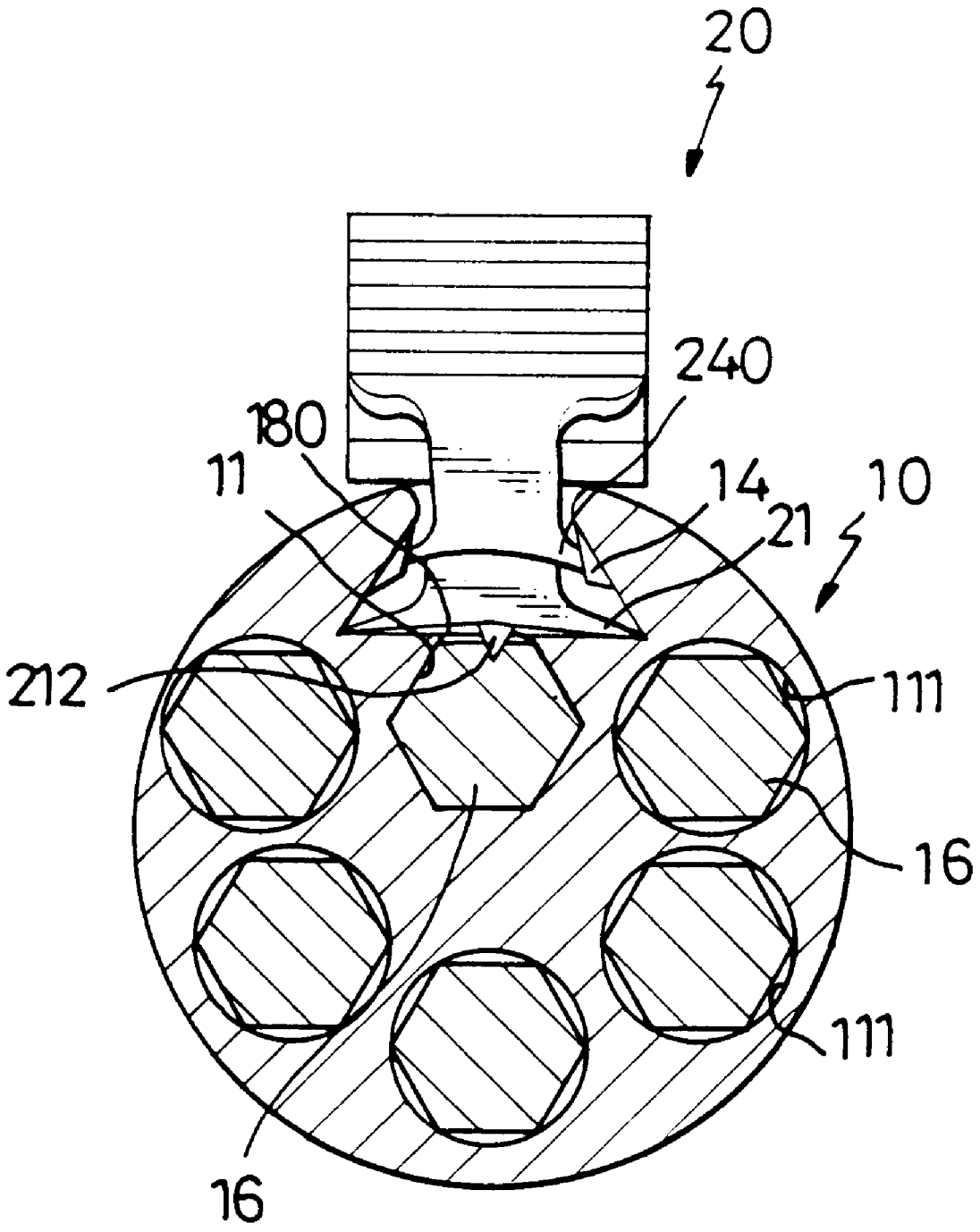
FIG. 9 is a side cross-sectional view of a mechanical pencil structure according to a third embodiment of the present invention.

Referring now to FIG. 9 with reference to FIG. 2, a plurality of chambers 111 are each longitudinally defined in the elongate housing 10 and each terminate at the second end portion of the elongate housing 10 for receiving a plurality of graphite rods 16 for use.

It should be clear to those skilled in the art that further embodiments of the present invention may be made without departing from the scope and spirit of the present invention.

What is claimed is:

1. A mechanical pencil structure comprising:

an elongate housing including a first end portion and a second end portion, a receiving passage longitudinally defined through said elongate housing, a substantially U-shaped guiding recess longitudinally defined in said elongate housing by two side walls and a bottom wall and located above said receiving passage, each of said two side walls defining said guiding recess having an upper portion formed with a plurality of ratchet teeth, an opening defined in said bottom wall defining said guiding recess and communicating with said receiving passage;

a pencil slidably received in said receiving passage and including a first end portion and a second end portion located adjacent to said first and said second end portion of said elongate housing respectively; and a control member slidably mounted in said guiding recess and securely engaged with said second end portion of said pencil for moving said pencil, said control member including a sliding base slidably received in said guiding recess, a plurality of engaging teeth fixedly mounted on an underside of said sliding base and securely engaged in said second end portion of said pencil, and an inverted L-shaped resilient plate having a vertical section extending upwardly from said sliding base and a horizontal section formed with a pawl detachably meshing with said ratchet teeth of each of said two side walls defining said guiding recess.

2. The mechanical pencil structure according to claim 1, wherein an abutting stub extends from said underside of said sliding base and abuts on said second end portion of said pencil.

3. The mechanical pencil structure according to claim 1, further comprising an end cap abutting on said second end portion of said elongate housing and including a plug detachably received in said receiving passage.

4. The mechanical pencil structure according to claim 1, wherein each of said two side walls defining said guiding recess includes a bump located adjacent to said second end portion of said elongate housing.

5. The mechanical pencil structure according to claim 1, further comprising a pencil sharpener detachably mounted on said second end portion of said elongate housing and defining a socket for receiving said second end portion of said elongate housing.

6. The mechanical pencil structure according to claim 1, wherein said pencil has a hexagonal cross-section, and said receiving passage has a mating hexagonal cross-section.

7. The mechanical pencil structure according to claim 1, wherein said pencil has a cylindrical cross-section, and said receiving passage has a mating cylindrical cross-section.

8. The mechanical pencil structure according to claim 7, wherein said pencil longitudinally defines a groove, and an elongate rib is formed on a wall defining said receiving passage and is received in said groove.

9. The mechanical pencil structure according to claim 7, wherein a plurality of chambers are longitudinally defined in said elongate housing and each terminate at said second end portion of said elongate housing.

* * * * *